United States Patent [19]

Mazur

[11] Patent Number: 4,489,521

[45] Date of Patent: Dec. 25, 1984

[54] APPARATUS FOR ABRADING WORKPIECES, PARTICULARLY SEMICONDUCTOR WAFERS

[75] Inventor: Robert G. Mazur, Monroeville, Pa.

[73] Assignee: Solid State Measurements, Inc., Monroeville, Pa.

[21] Appl. No.: 388,747

[22] Filed: Jun. 16, 1982

[51] Int. Cl.[3] ..... B24B 7/08

[52] U.S. Cl. ..... 51/161

[58] Field of Search ..... 51/129, 131.1, 131.3, 51/131.4, 154, 161, 162, 115, 117, 118, 124, 153, 155, 159

[56] References Cited

U.S. PATENT DOCUMENTS

| | | | |
|---|---|---|---|
| 1,046,505 | 12/1912 | Stuart | 51/155 |
| 1,069,329 | 8/1913 | Gronbech | 51/155 |
| 1,217,981 | 3/1917 | Nasief | 51/155 |
| 2,218,724 | 8/1937 | Rudd | 206/558 |
| 3,978,622 | 9/1976 | Mazur | 51/119 |

*Primary Examiner*—Frederick R. Schmidt
*Assistant Examiner*—Robert Rose
*Attorney, Agent, or Firm*—Thomas H. Murray; Clifford A. Poff

[57] ABSTRACT

An apparatus for abrading workpieces, particularly a semiconductor wafer, includes a spinner plate having acentral support and a finger pocket at one end to rotate the plate about a collar that is affixed to the central part of an abrading plate. The spinner plate carries at its end opposite the finger pocket, a fixture used to support the workpiece for movement along a circular track on the abrading plate. The abrading plate is supported within a tray.

7 Claims, 3 Drawing Figures

APPARATUS FOR ABRADING WORKPIECES, PARTICULARLY SEMICONDUCTOR WAFERS

BACKGROUND OF THE INVENTION

The present invention relates to an apparatus for abrading a workpiece and while not limited thereto, the apparatus is particularly useful for lapping and polishing samples of semiconductive material to determine spreading resistance, resistivity and impurity concentration in the semiconductive sample.

In Mazur U.S. Pat. No. 3,628,137, there is described a technique for determining the foregoing parameters in a semiconductive sample by forming a surface at an angle with respect to the top of the sample in order that spreading resistance, for example, can be determined throughout the thickness of the sample. Mazur U.S. Pat. Nos. 3,277,610 and 3,426,484 disclose an apparatus and method for abrading workpieces in which the workpieces are freely movable on a polishing or lapping tray containing loose abrasive material. Eccentric motion is imparted to the tray by a rotary drive so that regions of the tray on which the workpieces are disposed undergo acceleration, thus moving the workpieces by inertial forces over the tray surface. The spacing of the workpieces is such that, in relation to the frictional forces on the workpieces exerted by the tray surface, as the workpieces are moved by inertial forces they contact each other so that the workpieces are randomly displaced over a substantial area during their movement. A resilient member is disposed along the outer periphery of the tray and suspended a slight distance above the tray by springs to facilitate continuous inertial movement. Rubber bands are stretched across the tray between opposing walls to subdivide the tray into compartments for retaining workpieces in the compartments. Mazur U.S. Pat. No. 3,978,622 discloses an abrading apparatus for workpieces wherein the workpiece is disposed on a lapping and polishing tray carried on a generally horizontal support plate. The plate is caused to oscillate or eccentrically rotate by a single, centrally-located eccentric arm. The plate is restrained against rotary movement about the eccentric arm by thrust bearings situated at the four corners of the tray and between the tray and a support housing.

The shuffling, random-type accelerations of the fixture and workpiece supported thereby along the tray to effect lapping and/or polishing may interrupt the application of uniform pressure between the surface of the sample of semiconductive material and the lapping or polishing surface. The fixture which has a substantial mass and extends several inches above the surface of the lapping or polishing surface of the plate can rock about its center of mass which is located above the lapping or polishing surface as the fixture is continuously accelerated by movement of the plate. The lapping or polishing operation on the sample of semiconductive material is carried out to produce a planar, beveled surface which, when measuring the spreading resistance, for example, forms an obtuse angle with an original planar surface of the specimen. Defective beveling of a sample of semiconductive material can take several forms. In one form, instead of a sharp intersection between the beveled surface and the original planar surface, a rounded bevel edge sometimes occurs between the two surfaces. The existence of a rounded transition zone makes it impossible to determine the beginning of the beveled surface. Also, in this transition zone, the depth of the specimen cross section which is being probed is not a linear function of stepped increments along the beveled surface.

Another form of defective beveling is a curved intersection between the beveled surface and the original planar surface with the curve lying in the plane of the original surface. This "bevel-edge arcing", as it is sometimes referred to in the art, is produced instead of a straight-line intersection between the original and beveled surfaces. When a curved intersection is produced between the beveled surface and the original surface, there is an indication that one or both of the surfaces are non-planar. When this defective beveling occurs, any means for determining the beveled angle which samples a finite width of the specimen along the arc will not provide a unique angle value. Shallower beveled angles are produced on thin specimens. The smaller angle means that there is a smaller included obtuse angle between the beveled surface which is produced on the specimen and the original planar surface.

Typical specimens have an overall thickness of 10–20 mils but, in many cases, the active layer of interest in the spreading resistance measurements can be as thin as a fraction of a micron. Defective beveling is more prevalent with specimens in which the layer of interest is so thin. The apparatus of the present invention eliminates the disadvantages of a motor-driven eccentric to impart rotary motion to a polishing plate and provides that the polishing surface is stationary to avoid imparting a vertical force component on a workpiece in a manner to eliminate tilting on the lapping or polishing plate so that the sample is always pressed by a uniform force against the plate. The apparatus is designed to assure non-defective beveling which is more difficult to achieve when beveling thinner specimens which must have a smaller beveled angle.

SUMMARY OF THE INVENTION

It is an object of the present invention to provide a new and improved apparatus for abrading a workpiece upon a stationary lapping or polishing plate by a continuous circular track motion of the workpiece.

In accordance with the present invention, an abrading apparatus for workpieces of the general type described above is provided wherein an abrading plate is provided with a generally upstanding pivot support while the plate is, in turn, supported in a generally horizontal plane, a drive arm with a driven arm portion extending radially from a pivot engageable with the pivot support for rotation of the drive arm above the abrading plate, a workpiece holder engaged with the driven arm portion for rotating a workpiece carried thereby about the pivot along a circular track on the abrading surface of the abrading plate, and means for imparting rotary motion to the drive arm.

In the preferred form of the present invention, the aforesaid means for imparting rotary motion to the drive arm includes a radial arm section extending from the drive arm for rotating it about the pivot support. A finger pocket in the radial arm section is provided to efficiently impart torque to the drive arm. Skid means project from the underside of the drive arm to engage with the abrading plate for supporting the arm section above the plate. The drive arm and the radial arm section preferably comprise a rectangular spinner plate with a disc held by a releasable fastener to the bottom surface thereof to form the aforementioned pivot. It is preferred to provide a slot in the spinner plate to receive the fastener and releasably hold the disc at any one of different positions for preselecting a circular track for a workpiece along the abrading plate. The means for supporting the abrading plate preferably takes the form of a tray having raised plate support surfaces on the bottom wall thereof and protruding support surfaces from the side walls to hold the abrading plate in place.

These features and advantages of the present invention as well as others will be more fully understood when the following description of the preferred embodiment of the present invention is read in light of the accompanying drawings, in which.

Figure 1:
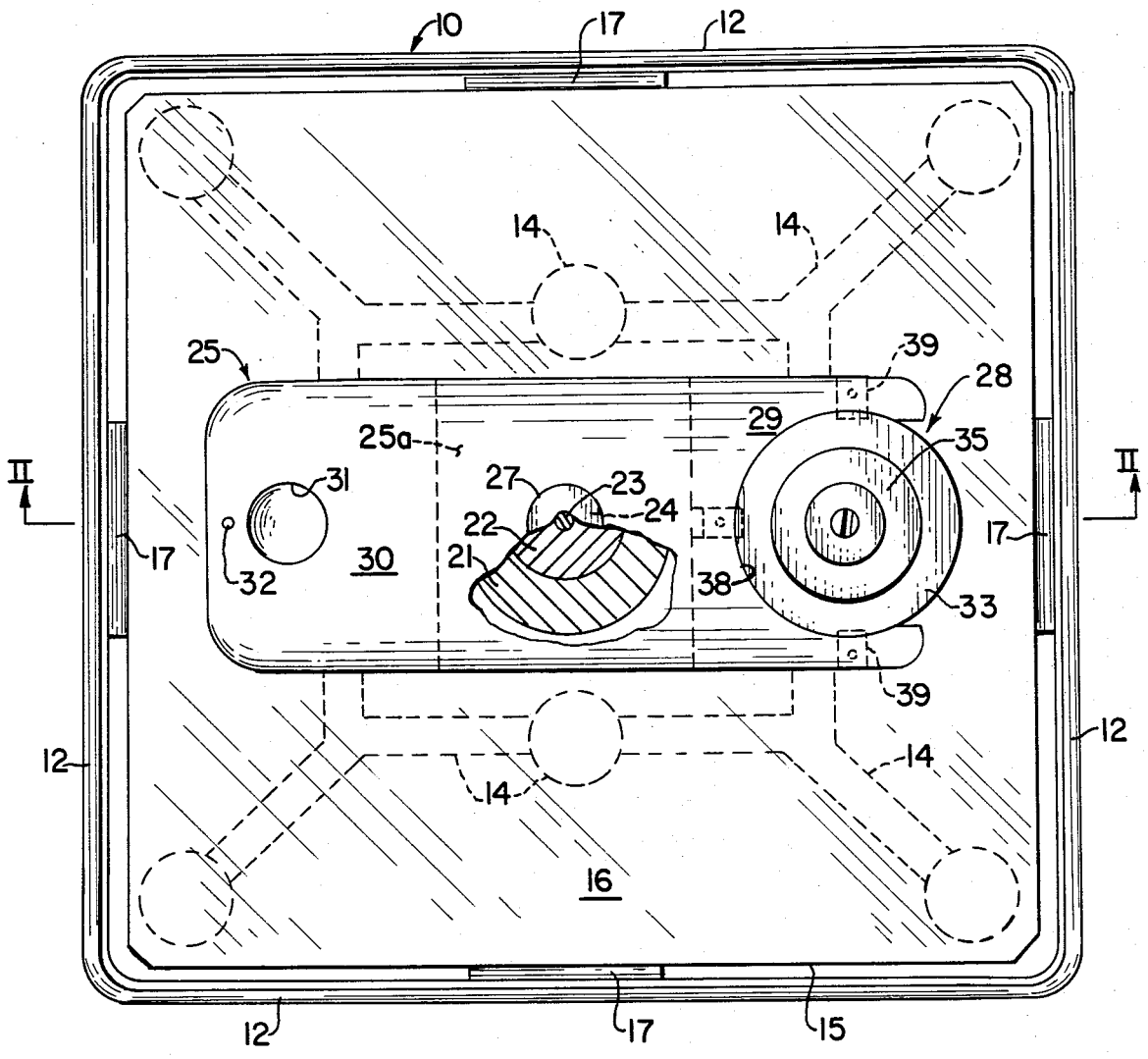
FIG. 1 is a plan view of the apparatus for abrading a workpiece according to the present invention.
Figure 2:
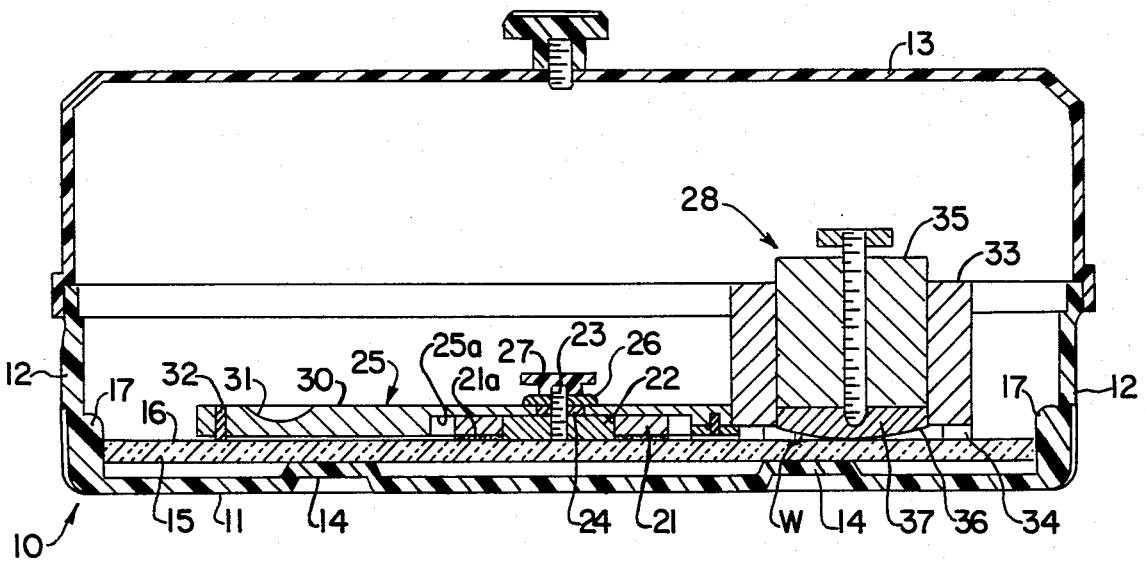
FIG. 2 is a sectional view taken along line II—II of FIG. 1.
Figure 3:
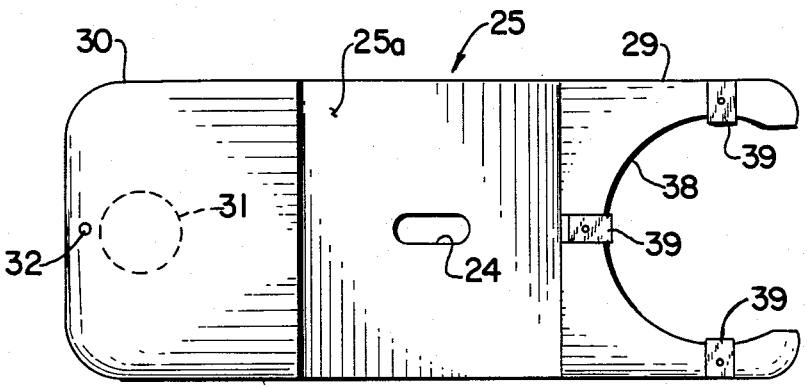
FIG. 3 is a plan view of the underside of a spinner plate forming part of the apparatus shown in FIG. 1.

With reference now to the drawings and particularly to FIGS. 1 and 2, the lapping and polishing apparatus shown includes a tray 10 having a floor 11 for support on a suitable horizontal surface such as a table or the like. The floor 11 is joined about its peripheral edges with upstanding side walls 12, the upper edges of which form a rim section to engage with a cover 13 (FIG. 2). The cover is placed on the tray when not in use to prevent entrance of dust or other contaminants on the tray. The tray is preferably formed from suitable molded plastic material and provided with a pattern of raised pads 14 to engage with a lapping or polishing plate 15. The raised pads are dimensioned to prevent wobbling of the plate and form a storage reservoir between the plate and the floor of the tray for any residual amounts of a suitable abrasive material, typically a diamond with a grain size in the range of 0.1 to 0.5 micrometer suspended in a liquid or paste carrier. The abrasive material is deposited on an abrading surface 16 of the plate. One suitable form of an abrading plate comprises a sheet of glass that is lapped with 5-micron alumina which produces a frosted appearance to the plate and is suitable to retain a thin film of abrasive material. The side walls of the tray are formed with inwardly-protruding pads 17 to prevent unwanted shifting of the lapping plate between the side walls of the tray. The lapping plate is dimensioned to fit closely between the pads 17 on the side walls of the tray.

The lapping plate shown in the drawings is square and centrally situated on the lapping surface 16 of the plate is an annular collar 21 which is adhered to the plate by a suitable adhesive film 21A. A disc 22 is set in the annular opening of the collar 21 by a close tolerance fit. The disc has a threaded bore in its center to receive threads on a support shaft 23 that extends from the disc through a slotted opening 24 in a spinner plate 25 and thence through a washer 26 to a knurled knob 27. Thus, it can be seen that a fastening means is provided by these parts which permits anchoring or fastening of the disc at a desired site along the slotted opening in the spinner plate which is selected according to desired track on the lapping plate for rotary movement of a fixture 28 carried at one end of the spinner plate by torque applied to the other end of the spinner plate. The spinner plate, therefore, forms a drive arm with the driven arm portion 29 extending from the disc 22 to the fixture and an oppositely-extended drive arm portion 30 having a finger pocket 31 comprising a shallow recess in the top surface of the drive arm. The finger pocket assures efficient transmission of torque from an operator's finger moved about the support disc in a circular manner to rotate the spinner plate. Since the operator will normally apply a downward force to maintain engagement with the finger pocket, a skid 32 is movably positioned by an adjustable fastener to maintain a generally parallel relation and prevent contact between the spinner plate and the lapping plate. The plate 25 has a transverse recess 25A to receive disc 22 and collar 21.

The fixture 28 which is supported at the driven end of the spinner plate is, per se, well known in the art. The fixture comprises an outer cylindrical casing 33 having slots 34 at its lower end to permit an abrasive material on the lapped surface of the lapping plate to pass into the interior of the cylindrical casing. A solid, cylindrical workpiece carrier 35 can slide in the housing such that the force of gravity acting on the carrier will bring a workpiece W on one of two sloping areas 36 formed on a carrier attachment 37 into load-bearing contact with the abrading surface of the plate. The spinner plate has a circular recess 38 to receive the housing 33 where it is engaged by fingers 39 that extend from the plate into the recess and thereby prevents rotation of housing 33 in the recess.

In operation, the workpiece is secured to the lower surface of the workpiece carrier. In the case of a semiconductor wafer an adhesive, e.g., beeswax and rosin, is preferably used to adhere the semiconductive sample or workpiece to the carrier. After the workpiece is affixed to the carrier, the carrier is inserted into the cylindrical housing and the housing is placed within the circular recess of the spinner. The housing is rotated, if necessary, to engage the slots 34 at the lower end of the housing with the fingers 39. A suitable abrasive material, as heretofore described, is deposited as a film on the abrading surface of the abrading plate. Thereafter, the operator rotates the spinner arm by hand using the finger pocket. Before rotating the spinner, it is preferably desired to orientate the workpiece with respect to the track of movement such that the workpiece trails in the rotary motion. Thus, the abrasive action is directed across the bevel surface towards and at a right angle to the bevel edge formed by the bevel surface and the original planar surface of the sample. The beveled surface of the semiconductive sample is relatively small, e.g., less than 1/16"×1/16" in relation to the diameter of the track, e.g., 5 inches, about which it is moved during the lapping or polishing operation so that the abraded surface on the sample is defined by substantially linear and parallel lines of abrasion. This enhances the spreading resistance measurements when compared with for example, random-type lines of abrasion that occur when using the apparatus known in the art as described hereinbefore.

Although the invention has been shown and described in connection with a certain specific embodiment, it will be readily apparent to those skilled in the art that various changes in form and arrangement of parts may be made to suit requirements without departing from the spirit and scope of the invention.

I claim as my invention:

1. Apparatus for abrading a workpiece, said apparatus comprising:

an abrading plate having an abrading surface and provided with a generally central upstanding pivot support, said pivot support including a collar secured to said abrading plate to extend above said abrading surface, means for supporting said abrading plate with said abrading surface in a generally upright orientation, a drive arm including a disc to engage said collar for rotary support by said pivot support such that a driven arm portion thereof extends radially from said pivot support, releasable fastening means for holding said disc at one of different positions on the drive arm to preselect a circular track for a workpiece along the abrading plate, a workpiece holder including an annular housing having a central through bore and a plunger which is axially slideable within said through bore, said plunger including a lower surface for carrying a workpiece, said driven arm portion including fingers extending into a circular recess for nonrotatably retaining said annular housings in the circular recess in an orientation such that vertical floating movement of said plunger in said housing gravitationally maintains a workpiece carried by said lower surface of said plunger in contact with said abrading surface, said drive arm including means engageable with said abrading plate for maintaining a generally parallel relation between said drive arm and said abrading plate to thereby maintain the axis of said through bore generally perpendicular to said abrading surface, and means for imparting a horizontal rotary motion to said drive arm for rotation thereof about said pivot support.

2. The apparatus according to claim 1 wherein said means for imparting rotary motion includes a radial arm section extending from said drive arm for rotating the drive arm about said pivot support.

3. The apparatus according to claim 2 wherein said radial arm section includes a finger pocket for applying a torque to impart such horizontal rotary motion to said drive arm.

4. The apparatus according to claim 1 wherein said drive arm and said means for imparting rotary motion comprise a rectangular spinner plate.

5. The apparatus according to claim 1 wherein said means for supporting includes a tray having a bottom wall joined with upstanding peripheral side walls.

6. The apparatus according to claim 5 wherein the bottom wall of said peripheral side walls of said tray includes raised support surfaces for said abrading plate.

7. The apparatus according to claim 2 wherein said means engageable with said abrading plate includes skid means carried by said radial arm section for engagement with said abrading surface.

* * * * *